United States Patent [19]

Gorris

[11] Patent Number: 4,850,400

[45] Date of Patent: Jul. 25, 1989

[54] WEFT YARN STORE WITH AUTOMATIC YARN MEASUREMENT

[75] Inventor: Joannes Gorris, Eindhoven, Netherlands

[73] Assignee: Sulzer Brothers Limited, Winterthur, Switzerland

[21] Appl. No.: 176,922

[22] Filed: Apr. 4, 1988

[30] Foreign Application Priority Data

Apr. 24, 1987 [CH] Switzerland ..... 1574/87

[51] Int. Cl.[4] ..... D03D 47/34

[52] U.S. Cl. ..... 139/452; 242/47.01

[58] Field of Search ..... 139/452; 242/47.01, 242/47.12

[56] References Cited

U.S. PATENT DOCUMENTS 4,444,226 4/1984 Ichikawa et al. ..... 139/452
4,627,474 12/1986 Tholander ..... 139/452

FOREIGN PATENT DOCUMENTS 142591 5/1985 European Pat. Off. ..... 139/452
9242 1/1984 Japan ..... 139/452
28550 2/1985 Japan ..... 139/452
289650 12/1987 Japan ..... 139/452

*Primary Examiner*—Henry S. Jaudon
*Attorney, Agent, or Firm*—Kenyon & Kenyon

[57] ABSTRACT

The weft yarn store comprises a rotating winder and a stationary drum adapted to receive a yarn winding. A drive in the form of a motor or magnets is disposed at least to some extent inside the drum to activate an adjusting sleeve to move the stirrups of the drum. The power required for the drive is transmitted without contact. Consequently, the effective diameter of the store drum can be adjusted while the store is in operation and automatically.

13 Claims, 8 Drawing Sheets

Fig. 3b
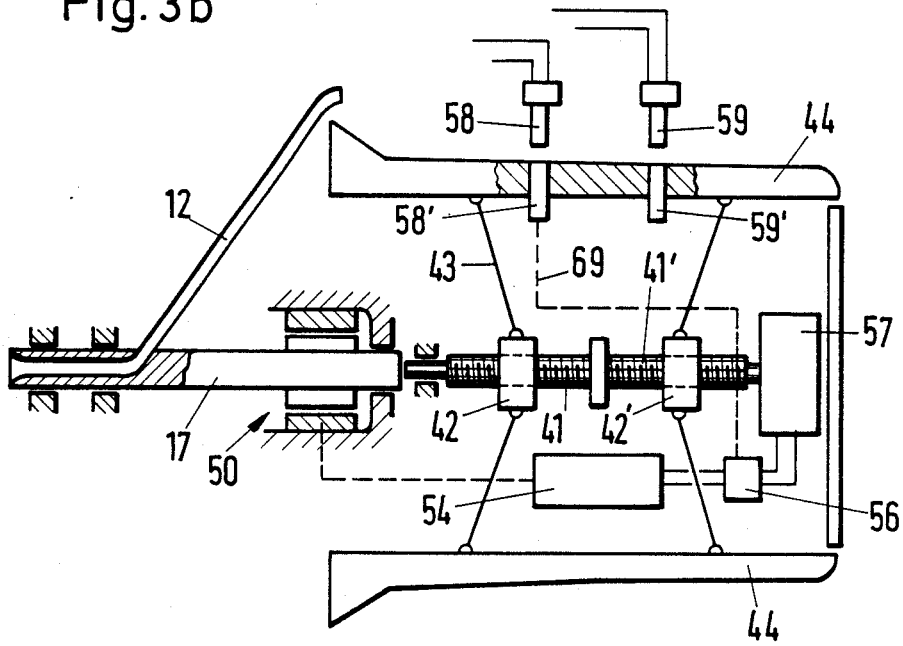
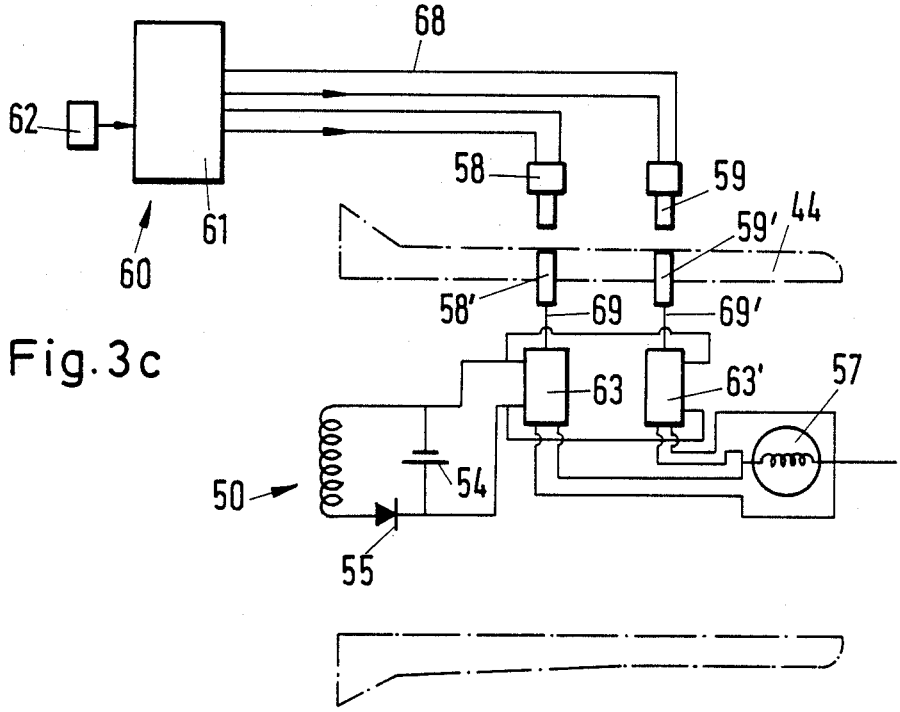
Fig. 3c

WEFT YARN STORE WITH AUTOMATIC YARN MEASUREMENT

This invention relates to a weft yarn store with an automatic yarn measurement.

Heretofore, various types of weft yarn stores have been known for the picking of yarn into a loom. For example, European Patent Application No. 0181985 describes a weft yarn store having a rotating winder and a stationary drum which is mounted on a shaft of the winder and which is adapted to receive a winding of yarn. In addition, the drum is provided with parts which may be adjusted by an adjusting means so as to vary the diameter of the drum parts manually. However, such a store must be stopped in order to be adjusted since direct access to the adjusting means has been impossible while the yarn is winding on and off the store.

As a rule, the one way of varying the yarn length to be delivered to the loom in cases in which the length is required to be measured very accurately is by repeated adjustment However, repeated adjustments of the store with corresponding interruptions in operation has been very time consuming. Further, should the yarn structure or elasticity vary when the store operates over a prolonged period of time, the length of yarn delivered to the loom may vary in time although the store may have been originally adjusted in an accurate manner.

Accordingly, it is an object of the invention to provide for the automatic adjustment of a yarn store in order to vary the length of a picked yarn.

It is another object of the invention to provide for the adjustment of a yarn store during operation.

It is another object of the invention to be able to adjust the yarn length delivered from a weft yarn store in a remote controlled manner during operation.

Briefly, the invention provides a weft yarn store which is comprised of a rotatable winder shaft having a winder thereon, a stationary drum having circumferentially spaced elements for receiving a sequence of yarn windings from the winder, adjustment means for adjusting the position of at least some of the elements in order to vary the length of a yarn picked from the drum and drive means for activating the adjusting means. This drive means is disposed at least in part within the drum.

The yarn store is also provided with an energizing means for transmitting drive energy to the drive means in noncontact manner.

In one embodiment, the drive means is in the form of a remotely controlled electric motor within the drum. In this case, the energizing means includes a winding connected to the motor and a magnet mounted on the winder shaft within the winding in order to generate a current therein in response to rotation of the shaft. This current can then be supplied to the motor via a suitable switch from time-to-time in order to activate the adjusting means.

In another embodiment, the energizer means for the motor includes a magnetic means outside the drum and a second magnetic means inside the drum which is connected to the motor. In this embodiment, the magnetic means are spaced from each other with the magnetic means outside the drum generating a current in the magnetic means within the drum for subsequent transmission to the motor.

In still another embodiment, the drive means may be a magnetic drive means. For example, a magnetic means may be disposed outside the drum while a second magnetic means is disposed inside the drum and connected to the adjusting means. In this arrangement, the magnetic means outside the drum is movable so as to cause movement of the magnetic means within the drum so as to activate the adjusting means.

The invention also provides a method of operating a weft yarn store having a drum with circumferentially spaced elements for carrying yarn windings and an adjusting means for adjusting at least some of the elements to vary the length of the yarn to be picked from the drum. With this method, the length of a weft yarn picked into a loom from the store is measured and the adjusting means is automatically activated in response to a measurement falling outside a predetermined range in order to adjust the elements to change the length of the yarn thereon. With this method, a desired weft yarn length value may be programmed in a controller and the adjustment means adjusted and re-adjusted without direct external access in dependence thereon so that the weft yarn length remains accurate over a prolonged period of operation of the store.

These and other objects advantages of the invention will become more apparent from the following detailed description taken in conjunction with the accompanying drawings wherein.

Figure 2:
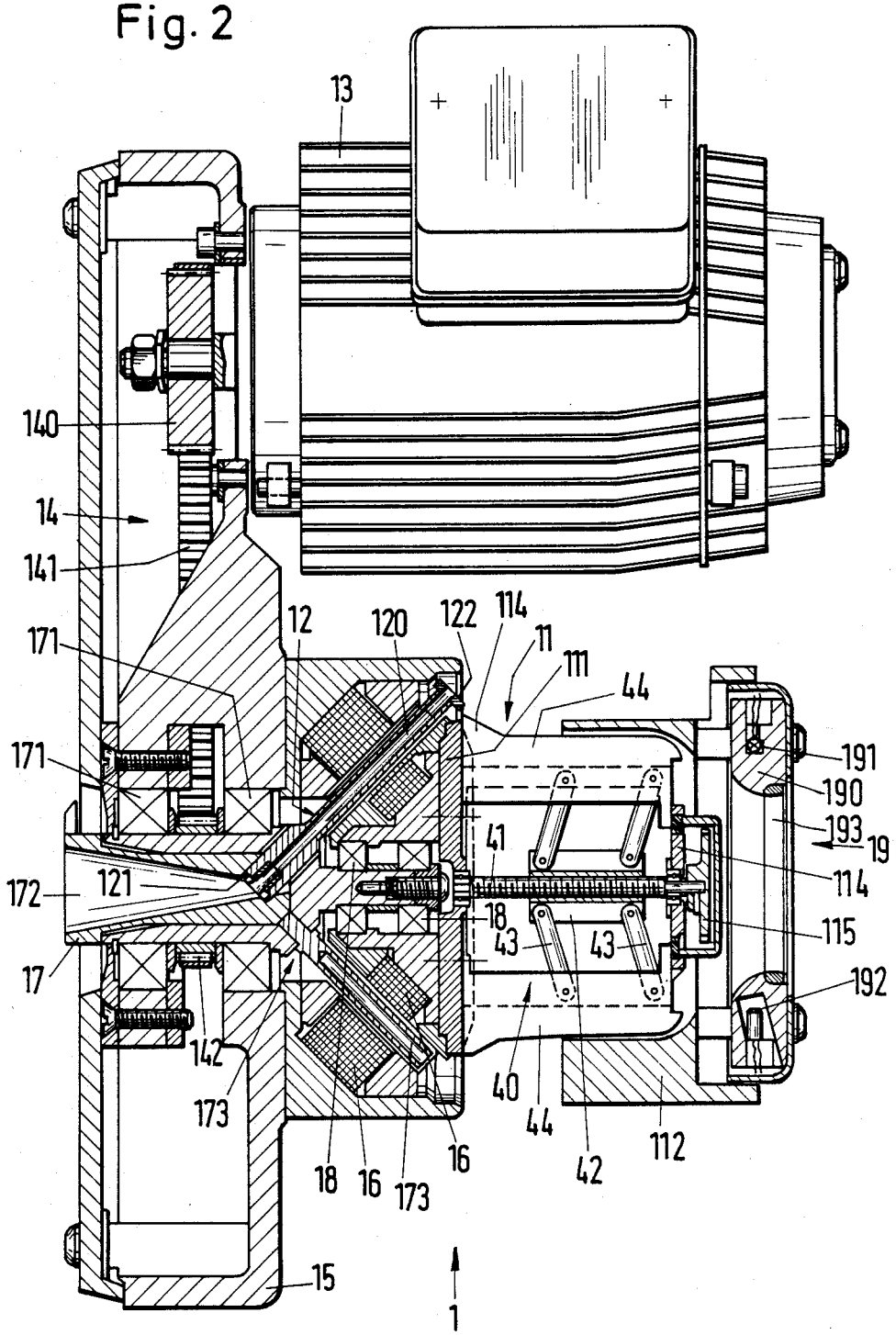
FIG. 2 illustrates a cross-sectional view of a yarn store having an adjusting means in accordance with the invention.
Figure 3A:
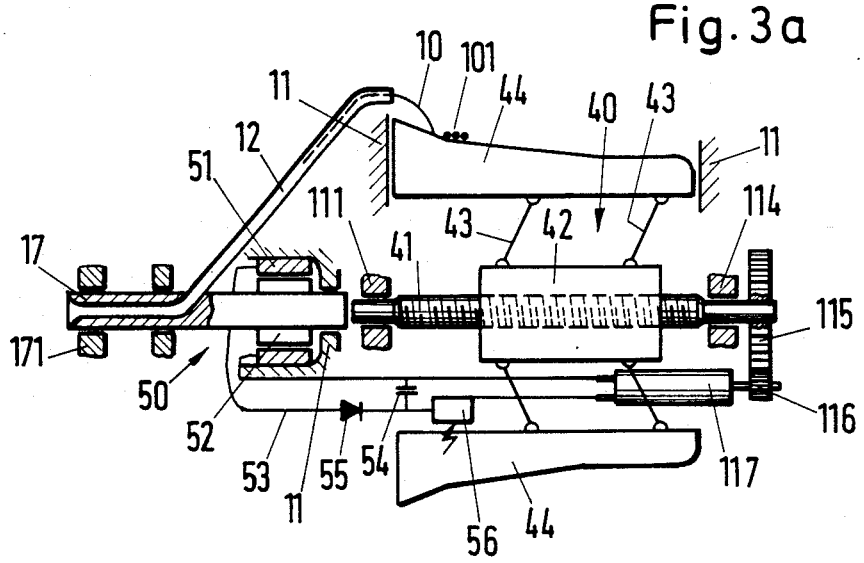
Figure 3D:
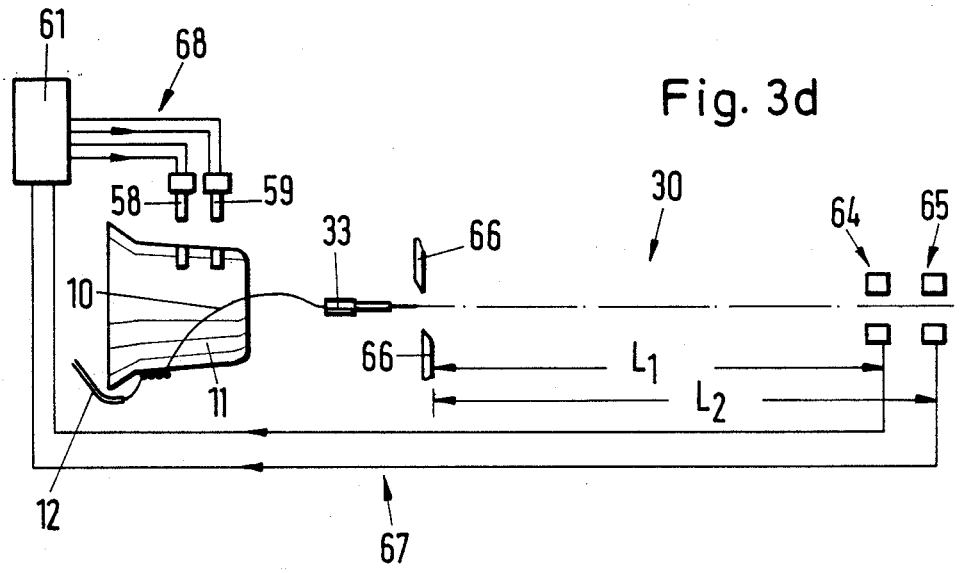
Figure 4A:
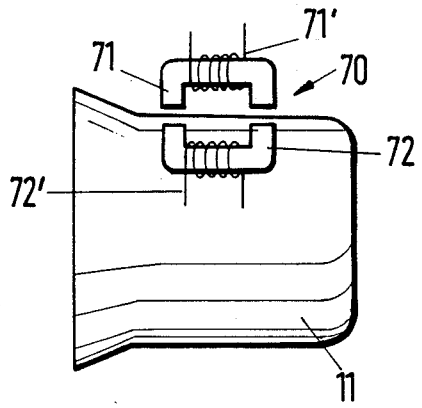
Figure 4B:
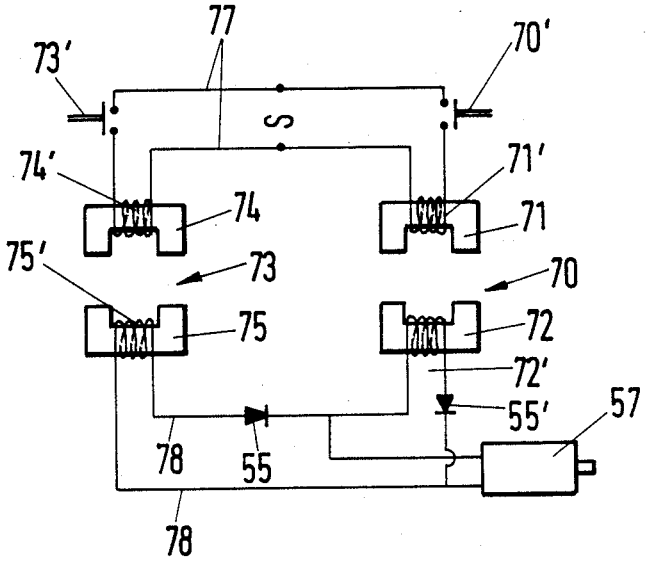
Figure 4C:
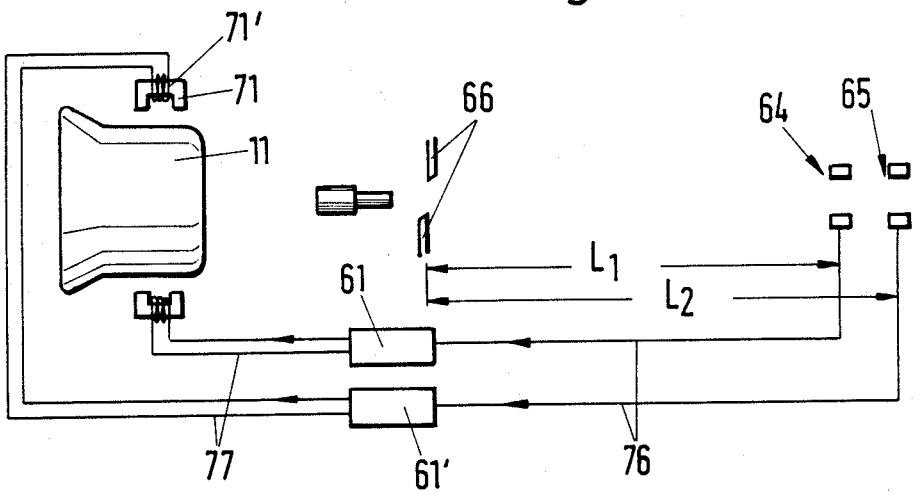
Figure 5A:
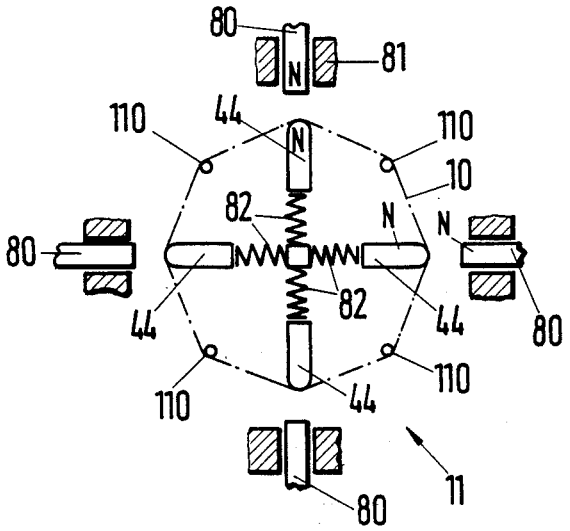
Figure 5B:
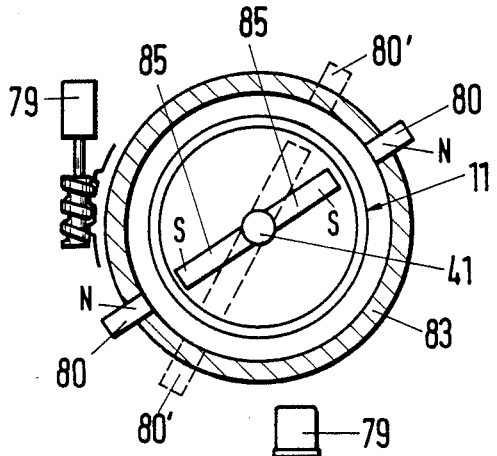
Figure 5C:
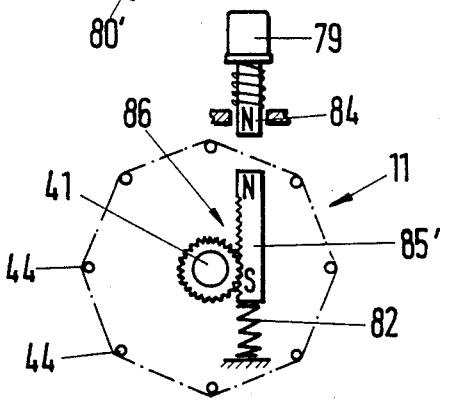
Figure 6C:
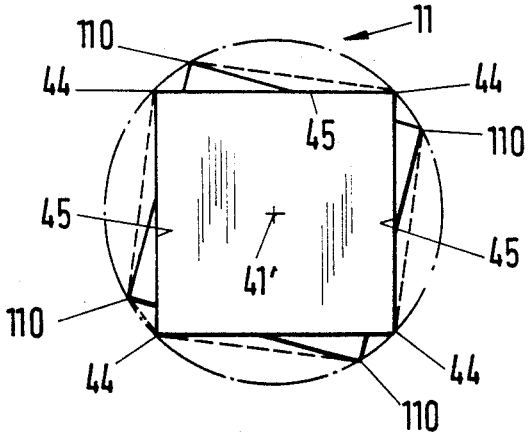
Figure 6B:
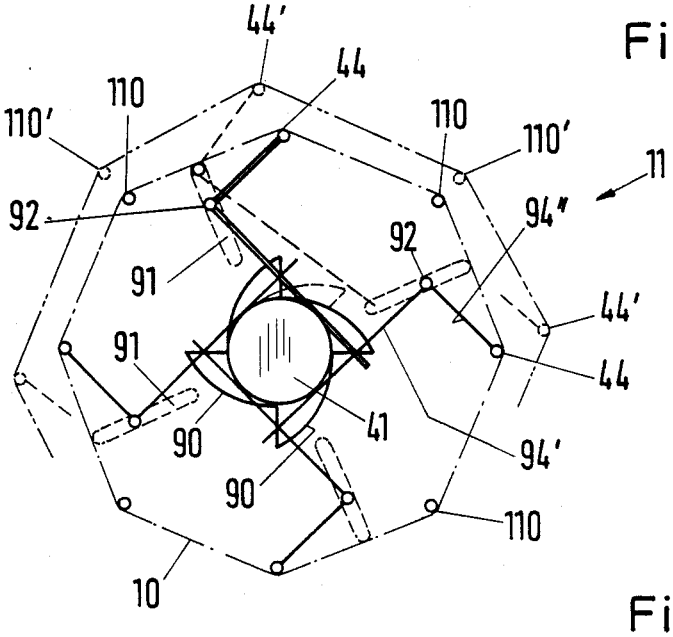
Figure 6A:
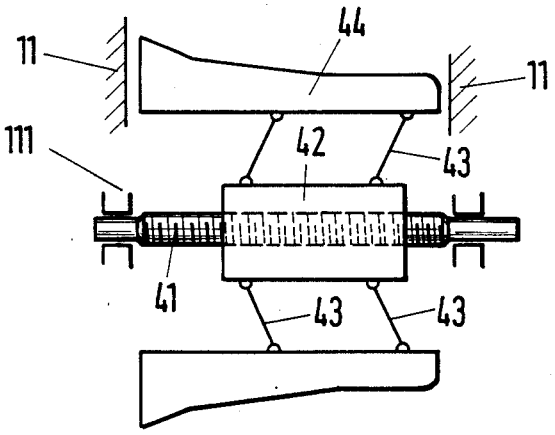
Figure 7A:
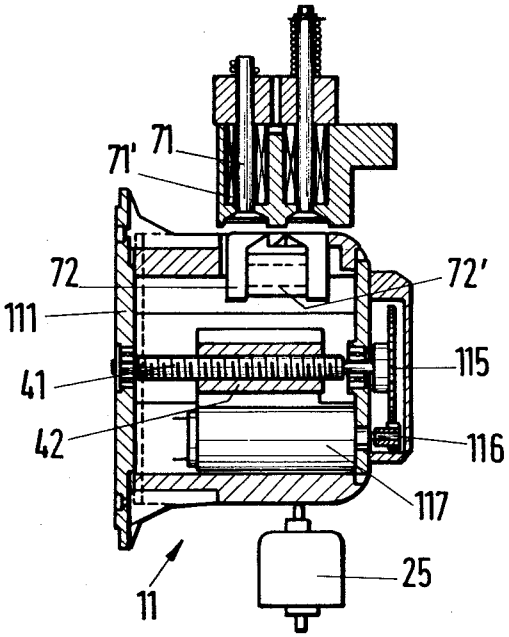
Figure 7B:
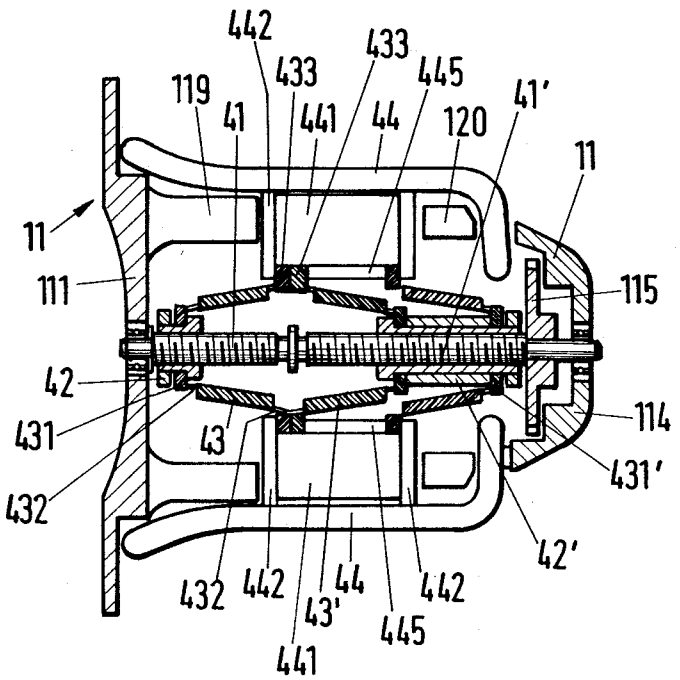

FIG. 3*a* diagrammatically illustrates a drive means and energizing means for the adjustment means of the weft yarn store of FIG. 2;

FIG. 3*b* diagrammatically illustrates a modified adjusting means in accordance with the invention;

FIG. 3*c* illustrates a schematic electrical circuit for the drive means for the drum adjusting mean in accordance with the invention;

FIG. 3*d* illustrates a control diagram for an automatic weft yarn length control in accordance with the invention;

FIG. 4*a* illustrates one embodiment of an energizing means for the drive means of the weft yarn store;

FIG. 4*b* illustrates a further energizing means for a drive motor in accordance with the invention;

FIG. 4*c* schematically illustrates an embodiment for automatic weft yarn length adjustment;

FIG. 5*a* illustrates a magnetic arrangement for magnetically adjusting the drum elements in accordance with the invention;

FIG. 5*b* illustrates a further magnetic arrangement for activating an adjusting means in accordance with the invention;

FIG. 5*c* iillustrates a further magnetic arrangement for activating the adjusting means;

FIG. 6*a* illustrates a side view of an adjusting means connected to drum elements in accordance with the invention;

FIG. 6*b* illustrates a modified arrangement of movable drum elements in accordance with the invention;

FIG. 6*c* iillustrates a further modified arrangement of movable drum elements;

FIG. 7*a* illustrates a remote controlled weft yarn store in accordance with the invention; and FIG. 7*b* illustrates a cross sectional view of a weft yarn store constructed in accordance with the invention.

Figure 1:
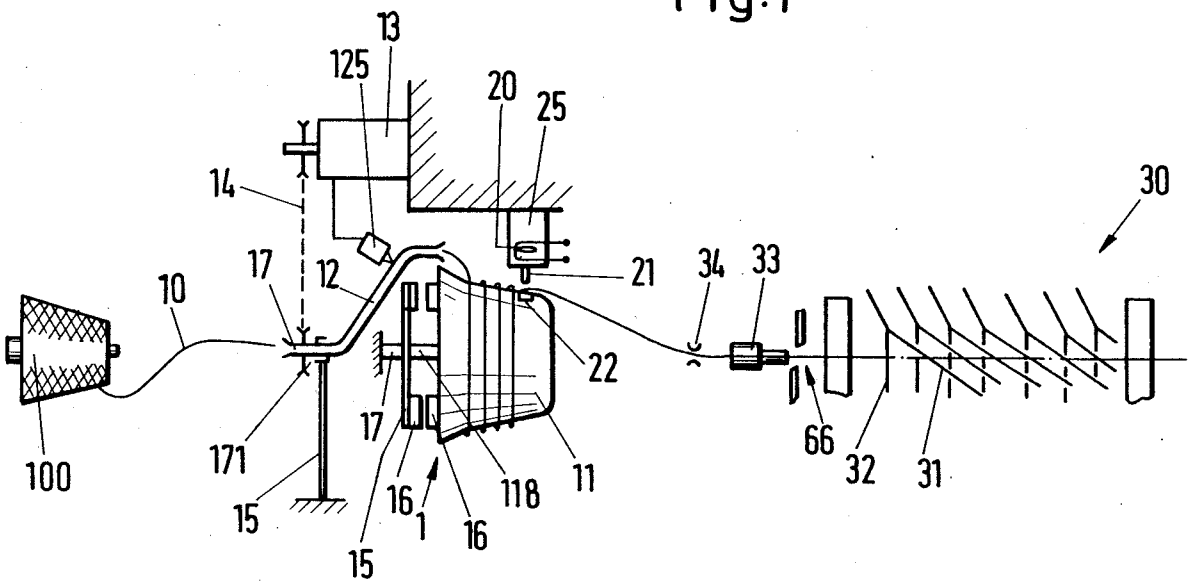
FIG. 1 illustrates a schematic view of a weft yarn store for a loom constructed in accordance with the invention.

Referring to FIG. 1, a weft yarn 10 to be processed in a loom 30 is drawn off a yarn package 100 by a weft yarn store 1 and subsequently delivered to the loom 30. As indicated, the weft yarn store 1 includes a winder 12 for winding the weft yarn in a plurality of windings onto a stationary drum 11. In addition, an eye 34 is spaced from the drum 11 for guiding the yarn 10 axially from the drum 11 into an air jet nozzle 33 for picking the weft yarn 10 into a shed formed by warp yarns 31, 32 in the loom 30.

Referring to FIG. 2, the weft yarn store 1 includes a funnel 172 within a winder shaft 17 through which the weft yarn enters prior to passage into the winder 12. The winder 12 which is shown schematically in FIG. 1 is formed of a tube 120 having eyes 121, 122 at opposite ends. This tube 120 is secured in the shaft 17 in known manner. In addition, a rod 173 which functions as a counterweight is disposed diametrically opposite the winder tube 120.

The winder shaft 17 is mounted via bearings 171 in a casing 15 and is driven by a controlled electric motor 13 by way of a drive 14, such as a belt drive 140, 141, 142. The drum 11 is mounted by way of a shaft 118 (FIG. 1) via radial bearings 18 on the winder shaft 17 and is prevented from rotating with the shaft 17 by magnet pairs 16. One magnet of each pair is disposed in the casing 15 and the other magnet is disposed in the drum 11.

After the weft yarn has been deposited on a conical part 114 of the drum 11, the windings of weft yarn slide to the right, as viewed in FIG. 2 onto the cylindrical part of the drum 11 for intermittent withdrawal therefrom.

Referring to FIG. 1, the weft yarn store includes an electromagnetic yarn clamp 25 which cooperates with the drum 11 in order to retain the weft yarn 10 thereon after picking. As indicated, the weft yarn clamp 25 includes a winding 20 which upon being energized moves a locking pin 21 onto an opposed abutment surface 22 of the drum 11 for retaining the weft yarn thereat.

The number of windings deposited on the drum 11 is checked by a sensor 125 which is connected to the motor 13 to stop the motor 13 when a sufficient number of windings have been deposited on the drum 11.

A cap 112 engags around the draw-off end of the drum II and co-operates therewith to bound a narrow annular gap for braking the turns of yarn leaving the store 1.

A monitor device 19 (FIG. 2) includes a monitor ring 190 which is secured by pins 114 to the cap 112 which serve as means for moving the ring 190 axially of the drum 11 in order to vary the braking of the departing weft yarn 10. The ring 190 is made of a transparent material, such as Plexiglass, and has a conical internal surface for circumferential sliding of the yarn balloon therein in order to limit the balloon of departing weft yarn. The exit edge of the ring 190 is protected by a wearing or replacement ring 193 made, for example, of hardened steel or of ceramic. In addition, the device 19 includes a pair of sensors mounted in the ring 190 for sensing the passage of the yarn.

Referring to FIG. 2, the drum 11 includes a plurality of circumferentially spaced elements 44 for receiving a sequence of yarn windings from the winder 12. In addition, an adjusting means 40 is provided within the drum 11 for adjusting the position of at least some of the elements 44 in order to vary the length of a yarn pick from the drum 11. As illustrated, the adjusting means 40 includes a spindle 41 which is rotatably mounted in opposite end flanges 111, 114 of the drum 11, a screw threaded sleeve 42 which is threadably mounted on the spindle 21 and a plurality of pairs of links 43 pivotally connected between the sleeve 42 and a respective element 44. In this respect, each element 44 is constructed as a stirrup.

The store 1 also has a drive means for activating the adjusting means 40. In this respect, only a gear 115 of the drive means is illustrated in FIG. 2.

Referring to FIG. 3*a*, the drive means includes an electric motor 117 which drives a pinion 16 which, in turn, meshes with the gear 115.

An energizing means is also provided for transmitting drive energy to the motor 117 in a non-contact manner. That is, the drive energy is derived from within the drum 11 without electrical lines extending from the drum 11 to the outside. As illustrated, the energizing means includes a generator 50 in the form of a dynamo having a winding 51 within the drum 11 and a magnet 52 on the winder shaft 17. During rotation of the shaft 17, current is generated in the winding 51 and delivered by a line 53 to an accumulator 54 via a rectifier 55 and a control 56. This kind of current generation is advantageous since, because of the nature of the construction of the weft yarn store, no direct electrical line can be brought to the store drum. When the adjusting means 40 is activated, the spindle 41 rotates so that the sleeve 42 moves axially on the spindle 41. The sleeve 42 is prevented from rotating since the stirrups 44 connected thereto by way of the links 43 are so guided in the drum 11 as to be able to move only radially. The axial movement of the sleeve 42 produces this radial movement. When there is a winding of weft 101 on the stirrups, the adjusting means 40 must be activated slowly and only when fresh yarn 10 is being continuously wound on the drum 11 and simultaneously drawn off therefrom, otherwise the yarn winding 101 my either be stretched excessively or become loose.

Referring to FIG. 3*b*, the adjusting means 40 can be controlled without contact by transmitters 58, 59 outside the drum, receivers 58', 59' respectively being disposed inside the drum and opposite the transmitters. The control signals can be transmitted from transmitter to receiver, for example, as light beams. The receivers 58', 59' are connected to the control 56 for the electric motor 57. In this embodiment, the motor 57 is directly connected to the spindle 41 and the spindle 41 has a first part with a right-hand screwthread and a second part with a left-hand screwthread 41, A corresponding screwthreaded sleeve 42, 42' respectively is associated with each part of the spindle.

Referring to FIG. 3*c*, wherein like reference characters indicate like parts as above, a set value of drum diameter may be communicated to the yarn store by means of a programmer 62 forming a part of the weft yarn store control 61. The control 61 converts the programmed value for drum diameter into control signals which are transmitted over lines 68 to the transmitters 58, 59 and thereby to the receivers 58', 59'. The receivers 58', 59' are shown in this embodimetn as being mounted in a stirrup 44. The transmitters 58, 59 are disposed in a mounting (not shown) radially above a stirrup of the drum 11. That part of the drum 11 which carries the yarn winding 101 cannot be in the form of a cylindrical generated surface but can be embodied as a number of stirrups disposed on the drum periphery, the weft yarn 10 being stretched over the stirrups, a single turn of weft yarn of the winding 101 forming a polygon on the drum periphery. The term "drum diameter" is to be understood as an imaginary parameter. The calculated value of drum diameter arises from the length of the yarn in the form of a polygon which extends around the drum stirrups, divided by the term $\pi$. Lines 69, 69' extend from the receivers 58, 58' respectively to respective switches 63, 63' each of which is connected to the motor 57 by an independent circuit. As will be apparent from the wiring of the generator 50, rectifier 55, accumulator 54, switches 63, 63' and motor 57, the polarities of the switches are the same on the input side but are reversed on the output side relatively to the motor connections. Consequently, the motor 57 runs forwards or backwards in response to actuation of the switches 63, 63', respectively, to vary the diameter of the stirrups 44 in one or the other direction.

FIG. **3*d* is a control diagram showing how the weft yarn length L to be picked into the loom is adjusted automatically. It is assumed that a predetermined number of turns of yarn are drawn off the drum 11 for one pick. The number of yarn turns drawn off is controlled by the yarn clamp 25 of FIG. 1. By alteration of the drum diameter—i.e., of the position of the stirrups 44—the length of a winding of yarn on the drum periphery and, therefore, the total length of the drawn-off yarn is altered. In picking into the loom, the yarn tip, which before picking extends out of the nozzle 33 and terminates at the cutters 66, reaches the zone between yarn sensors 64, 65 on that side of the loom which is remote from the picking nozzle 33. The distance between the sensors 64 and 65 corresponds to the region in which yarn length is adjusted between a minimum length Ll and a maximum length L2. The control 61 receives signals from the sensors 64, 65 by way of the lines 67 and transmits signals to the line 68*s* whenever it is required to alter the diameter of the drum 11. In normal weaving, the weft yarn tip is disposed between the sensors 64 and 65 after picking. To indicate this, the sensor 64 outputs a signal to the control 61 upon the passage of the yarn tip end the sensor 65 produces no signal. In the absence of a signal from the sensor 64 after a pick, i.e. when the yarn tip has not reached the sensor 64, the picked length of yarn is too short. In this event, the adjusting means 40 must increase the effective drum diameter. A signal from the sensor 65 indicates that too much yarn has been delivered by the store 1. In this event, the adjusting means 40 must reduce the effective drum diameter. The control 61 can therefore automatically set up a set-value yarn length even though the set value of the yarn length of the programmer 62** has been communicated inaccurately or when the structure of the weft yarn alters during the weaving process, so that the drawn-off yarn length L is also affected.

Referring to FIG. **4*a*, the energization of the accumulator 54 (FIG. 3*a*) can be by magnetic induction from the region outside the storage drum 11. To this end, a transformer 70 is embodied by a primary winding 71' which has an iron core 71 and which is outside the drum 11, together with a secondary winding 72' which has an iron core and which is inside the drum 11. The weft yarn moves in the zone between the cores 71 and 72** on the drum periphery.

Referring to FIG. **4*b*, a d.c. motor 57 can be directly energized by magnetic induction without any interposd accumulator by magnetic means, such as transformers 73, 70 outputting d.c. of the required polarity to the motor via rectifiers 55, 55'. In this event, the control for the motor 57 is also disposed outside the drum. The control closes switches 70' or 73' selectively, so that an alternating circuit is closed in the primary winding 71', 74' about a magnet 71, 74 of a respective transform 70, 73. Current is therefore induced in the respective secondary winding 72', 75' rectified and supplied to the motor 57**.

Referring to FIG. **4*c*, wherein like reference characters indicate like parts as above, the sensor 64, 65 for measuring the length of a picked yarn may each be connected via lines 76 to a control 61, 61' which, in turn, is connected via a line 77 to a respective primary winding 71', 74'. Thus, depending on the measured length, the motor 57** (not shown) may be driven in one or the other directions.

Referring to FIG. **5*a*, the stirrups 44 of the adjusting means can be adjusted without any electric motor. In this case, for example, electromagnets 80 are disposed outside the drum and opposite the stirrups 44 to function as a drive means. The magnetic field which is produced by the magnets 80 is assumed to be directed towards corresponding magnets (not shown) in the stirrups 44. These latter magnets together with springs 82 which bias the stirrups radially inwardly function as the adjusting means. When the magnetic field in the magnts 80 varies, the force applied externally to the stirrups 44 varies so that the position of the stirrups 44 varies until equilibrium has been restored between the differently deformed spring and the altered magnetic force. Consequently, the yarn stretched on the stirrups 44 and stationary stirrups 110 takes up a different position, so that the effective diameter of the drum 11** alters.

Referring to FIG. **5*b*, in another embodiment, a ring 83 is disposed outside the drum 11 for rotation about the drum spindle 41 via an electric adjusting motor 79. Disposed in the ring 83 is a magnet pair 80 which can act on a magnet pair 85 in the drum 11. The magnetic pair 85 is so connected to the spindle 41 of the adjusting means described above as to corotate with such spindle. When the ring 83 is adjusted in the peripheral direction, the magnet pair 85 follows the position of the magnet pair 80 into the position 80' and this rotates the spindle 41** to shift the stirrups (not shown).

Referring to FIG. **5*c*, in another embodiment, a magnet 84 is secured to a spindle of a drive unit 79 outside the drum 11 to act as a drive means to apply a force to a magnet 85' inside the drum 11, which is retained by a spring 82 and functions as an adjusting means. As described with reference to FIG. 5*a* an adjustment of the spindle and of the magnet 84 thereon produces a movement of the magnet 85', the same converting the thrust in a toothing 86 into a rotation of the spindle 41. The stirrups 44 are coupled with the spindle 41** in known manner.

FIGS. **6*a*–6*c* show other possibilities for varying the effective diameter of the drum by means of adjustable stirrups. Referring to FIG. 6*a*, the stirrups 44 are adjusted radially of the axis of the spindle 41 when the sleeve 42 moves axially on the spindle 41 and the links 43** take up a substantially inclined position.

FIG. **6*b* shows another adjusting means wherein cam segments 90 are disposed on the spindle 41 and arms of bent levers 94 bear on the cam segments 90. The known stirrups 44 are secured to the outer arms 94'' of the levers. When the spindle 41 turns, the position of the cam segments 90 relative to the corresponding bent lever arm 94' alters, so that the lever rotates around a pivot bearing 92. The stirrups 44 therefore move into a new position 44'. The effective drum diameter is fine-adjusted by rotation of the spindle 41, but a coarse adjustment is possible by the bent lever pivot bearings 92 being displaced in links 91. In addition to the movable stirrups 44, stationary stirrups 110 can also be provided whose position can be varied, for example, from position 110 to position 110', as required. The weft yarn 10 is stretched around a drum 11 over the stirrups 44 and 110**.

Referring to FIG. *6c*, the drum periphery is formed by the stirrups 44 which are interconnected by webs 45 and are rotatable as a whole around spindle axis 41', and by corresponding stirrups 110 on the drum periphery, the latter stirrups being stationary. When the position of the stirrups 44 alters relatively to the stirrups 110, the length of the turns of yarn deposited on the stirrups alters too. Rotation of the stirrups 44 of FIG. *6c* can be produced by facilities of the kind shown in FIG. *5b* or *5c*.

Referring to FIG. *7a*, one preferred embodiment of the weft yarn store includes an electric motor 117, drive 115, 116, adjusting spindle 41 and screwthreaded sleeve 42 thereon within the drum 11. For energy transmission, pole shoes 71 are disposed displaceably adjacent the drum 11 in the primary windings 71'. The magnetic flux passes over to the iron core 72 and secondary winding 72' in the drum 11, so that current is induced in the winding. Instead of this form of power supply, a chargeable accumulator can be disposed in the drum but must be replaced periodically if no provision is made for charging the accumulator.

FIG. *7b* shows the construction of the adjusting means shown diagrammatically in FIG. *3b*. The spindle 41 has a part 41' screwthreaded oppositely to the part 41. Screwthreaded sleeves 42, 42' move on these parts and are reciprocated when the spindle rotates. The sleeves 42, 42' carry a respective ring 431, 431' to which links 43, 43' are pivotally secured. To produce the pivoted connection, for example, between the ring 431 and the links 43, the pivot 432 can be in the form of a thin part of a plastics member which extends around the ring 431, link 43 and extension 433. The same is also pivotally connected to the link 43 and is secured to a holder 44 between plates 442 and by means of an intermediate element 445. The holder 441 carries one stirrup 44 each. The stirrups 44 are disposed around the drum periphery 11 at least in quadruplicate. The holders 441, intermediate members 445, links 43 and extensions 443 are then provided on the same number. The links 43' associated with the sleeve 42, are arranged in duplicate, to give a parallelogram link guidance for the holder 441 and also for the stirrup 44. Guides 119, 120 are provided on the drum for additional guidance of the holder 441.

The invention thus provides a weft yarn store which can be adjusted during operation so as to vary the length of a yarn to be picked.

The invention further provides a weft yarn store which can be re-adjusted from time-to-time in dependence upon the length of yarn picked.

What is claimed is:

1. A weft yarn store comprising a rotatable shaft having a winder thereon;

a stationary drum having circumferentially spaced elements for receiving a sequence of yarn windings from said winder;

adjusting means for adjusting the position of at least some of said elements to vary the length of a yarn picked from said drum;

drive means for activating said adjusting means; and energizing means for transmitting drive energy to said drive means, said energizing means including a winding within said drum and a magnet on said shaft spaced from said winding.

2. A weft yarn store as set forth in claim 1 wherein said drive means is disposed at least in part within said drum.

3. A weft yarn store as set forth in claim 1 wherein said drum elements are radially displaceable stirrups extending in coaxial parallel relation to said drum.

4. A weft yarn store as set forth in claim 3 wherein said adjusting means includes a spindle rotatably mounted within said drum, a screw threaded sleeve threadable mounted on said spindle, and a plurality of links between said sleeve and each said stirrup whereby said stirrups are movable radially in response to axial movement of said sleeve during rotation of said spindle.

5. A weft yarn store as set forth in claim 1 wherein said drive means includes an electric motor in said drum.

6. A weft yarn store comprising a rotatable shaft having a winder thereon;

a stationary drum having circumferentially spaced elements for receiving a sequence of yarn windings from said winder;

adjusting means for adjusting the position of at least some of said elements to vary the length of a yarn picked from said drum; and drive means for activating said adjusting means, said drive means including first magnetic means outside said drum and second magnetic means inside said drum and connected to said adjusting means, said first magnetic means being mounted relative to said second magnetic means to move said second magnetic means to activate said adjusting means.

7. A weft yarn store as set forth in claim 6 wherein said adjusting means includes a magnet on at least one drum element and a spring biasing said one element radially inwardly and said drive means includes an electromagnet outside said drum in spaced relation to said magnet for moving said one element radially outwardly under a variable magnetic field.

8. A weft yarn store as set forth in claim 6, wherein said drive means includes a rotatable ring outside said drum, a first magnet pair on said ring and a second magnet pair inside said drum connected to said adjusting means whereby rotation of said ring causes rotation of said second magnet pair and activation of said adjusting means.

9. A weft yarn store as set forth in claim 6 wherein said drive means includes an electromagnet outside said drum and a magnet within said drum for movement in response to energization of said electromagnet, said magnet being connected to said adjusting means to activate said adjusting means in response to movement of said magnet.

10. A weft yarn store comprising a rotatable shaft having a winder thereon;

a stationary drum having circumferentially spaced elements for receiving a sequence of yarn windings from said winder;

adjusting means for adjusting the position of at least some of said elements to vary the length of a yarn picked from said drum; and drive means for activating said adjusting means, said drive means including a remotely controlled electric motor within said drum.

11. A weft yarn store comprising a rotatable shaft having a winder thereon;

a stationary drum having circumferentially spaced elements for receiving a sequence of yarn windings from said winder;

adjusting means for adjusting the position of at least some of said elements to vary the length of a yarn picked from said drum;

drive means for activating said adjusting means;

an energy-transmitting electrical winding on said drum connected to said drive means; and means opposite said winding for producing a magnetic field to cause said winding to transmit a current to said drive means.

12. A weft yarn store comprising a rotatable shaft having a winder thereon;

a stationary drum having circumferentially spaced elements for receiving a sequence of yarn windings from said winder;

adjusting means for adjusting the position of at least some of said elements to vary the length of a yarn picked from said drum;

an electric motor in said drum for activating said adjusting means; and energizing means for transmitting current to said motor, said energizing means including a winding connected to said motor and a magnet mounted on said winder shaft within said winding to generate a current therein in response to rotation of said shaft.

13. A weft yarn store comprising a rotatable winder shaft having a winder thereon;

a stationary drum having circumferentially spaced elements for receiving a sequence of yarn windings from said winder;

adjusting means for adjusting the position of at least some of said elements to vary the length of a yarn picked from said drum;

an electric motor in said drum for activating said adjusting means; and energizing means for transmitting current to said motor, said energizing means including first magnetic means outside said drum and second magnetic means inside said drum and connected to said motor, said first magnetic means being spaced from said second magnetic means to generate a current therein.

* * * * *

UNITED STATES PATENT AND TRADEMARK OFFICE

CERTIFICATE OF CORRECTION

PATENT NO. : 4,850,400

DATED : July 25, 1989

INVENTOR(S) : JOANNES GORRIS

It is certified that error appears in the above-identified patent and that said Letters Patent is hereby corrected as shown below:

Column 2, line 40 "mean" should be -means-
Column 2, lines 58 and 65 "iillustrates" should be -illustrates-
Column 3, line 49 "engags" should be -engages-
Column 3, line 50 "lI" should be -ll-
Column 4, line 54 "41," should be -41'.-
Column 5, line 46 "end" should be -and-
Column 6, line 2 "interposd" should be -interposed-
Column 6, line 9 "transform" should be -transformer-
Column 6, line 31 "magnts" should be -magnets-
Column 6, line 44 "corotate" should be -co-rotate-
Column 6, line 67 "arms" should be -arms 94'-
Column 6, line 68 "levers 94" should be -levers-
Column 7, line 3 "segments" should be -segment-
Column 7, line 56 "42," should be -42'-
Column 8, line 21 "threadable" should be -threadably- and
"spindle" should be -spindle-

Signed and Sealed this

Twenty-second Day of January, 1991

*Attest:*

HARRY F. MANBECK, JR.

*Attesting Officer*

*Commissioner of Patents and Trademarks*